US010183494B2

(12) United States Patent
Arima et al.

(10) Patent No.: US 10,183,494 B2
(45) Date of Patent: Jan. 22, 2019

(54) INKJET RECORDING APPARATUS

(71) Applicant: Hitachi Industrial Equipment Systems Co., Ltd., Chiyoda-ku, Tokyo (JP)

(72) Inventors: Takahiro Arima, Tokyo (JP); Mitsuo Igari, Tokyo (JP); Mamoru Okano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/611,947

(22) Filed: Jun. 2, 2017

(65) Prior Publication Data

US 2017/0348977 A1 Dec. 7, 2017

(30) Foreign Application Priority Data

Jun. 3, 2016 (JP) ..... 2016-111428

(51) Int. Cl.

| | |
|---|---|
| ***B41J 2/175*** | (2006.01) |
| ***B41J 2/185*** | (2006.01) |
| ***B41J 2/09*** | (2006.01) |
| ***B41J 2/085*** | (2006.01) |
| ***B41J 2/095*** | (2006.01) |
| ***B41J 29/13*** | (2006.01) |

(52) U.S. Cl.

CPC ..... *B41J 2/185* (2013.01); *B41J 2/085* (2013.01); *B41J 2/09* (2013.01); *B41J 2/095* (2013.01); *B41J 2/175* (2013.01); *B41J 2/17513* (2013.01); *B41J 29/13* (2013.01); *B41J 2002/1853* (2013.01)

(58) Field of Classification Search

CPC .... B41J 2/075; B41J 2/175; B41J 2002/1853; B41J 2/185

See application file for complete search history.

(56) References Cited

FOREIGN PATENT DOCUMENTS

| | | | | |
|---|---|---|---|---|
| CN | 1225291 | A | 8/1999 | |
| CN | 102029785 | A | 4/2011 | |
| CN | 104401042 | A | 3/2015 | |
| CN | 105269707 | A | 1/2016 | |
| CN | 105452000 | A | 3/2016 | |
| EP | 0 822 000 | A1 | 2/1998 | |
| JP | 60-110458 | * | 6/1985 | |
| JP | 08-257387 | * | 10/1996 | ..... B01F 13/08 |
| JP | 2000-126577 | * | 5/2000 | ..... B01F 13/08 |

(Continued)

OTHER PUBLICATIONS

Extended European Search Report issued in counterpart European Application No. 17000928.6 dated Oct. 17, 2017 (Thirteen (13) pages).

(Continued)

*Primary Examiner* — Huan H Tran
(74) *Attorney, Agent, or Firm* — Crowell & Moring LLP

(57) ABSTRACT

An inkjet recording apparatus includes an ink container. The ink container stores an ink for printing on a printing object. The inkjet recording apparatus also includes a stirring mechanism. The stirring mechanism stirs the ink stored in the ink container. The stirring mechanism includes a stationary shaft and a rotating body. The rotating body rotates around the stationary shaft. The stationary shaft and rotating body are placed in a lower part of the ink container.

17 Claims, 9 Drawing Sheets

(56) References Cited

FOREIGN PATENT DOCUMENTS

| | | | | | |
|---|---|---|---|---|---|
| JP | 2000-185223 | | * | 7/2000 | ..... B01F 7/00 |
| JP | 2002-200765 | A | | 7/2002 | |
| JP | 2007-331290 | | * | 12/2007 | ..... B41J 2/175 |
| JP | 2011-67775 | A | | 4/2011 | |
| JP | 2015-071263 | | * | 4/2015 | ..... B41J 2/175 |
| JP | 2015-71263 | A | | 4/2015 | |
| WO | WO 2015/049918 | A1 | | 4/2015 | |

OTHER PUBLICATIONS

Chinese-language Office Action issued in counterpart Chinese Application No. 201710403724.4 dated Aug. 31, 2018 (seven (7) pages).

* cited by examiner

INKJET RECORDING APPARATUS

BACKGROUND AND SUMMARY

The embodiments of the invention relate to an inkjet recording apparatus, and particularly relate to an inkjet recording apparatus in which an ink in an ink container is stirred and ink particles are continuously ejected.

An inkjet recording apparatus of a continuous system performs recording by sucking an ink from an ink container with a pump, supplying the ink to a nozzle through an ink filter and a pressure regulating valve which regulates the pressure of the ink, applying oscillation to the ink ejected from the nozzle to generate ink particles, and charging and deflecting the ink particles so as to allow the ink particles to reach a recording medium. Further, the apparatus adopts a circulation mechanism in which the ink is continuously ejected from the nozzle, and the ink particles which are not used for recording are collected by a gutter unit and returned to the container storing the ink by the force of the pump, and then, supplied to the nozzle again.

In the case where printing is performed on the surface of a recording medium of a dark color such as black, when a widely used dye-based ink is used, letters printed with a similar color to the color of the surface of the recording medium are hard to read, and therefore, printing is performed using a pigment-based ink of a bright color such as white or yellow, or printing is performed using a complementary color.

The pigment-based ink has a problem that when it is left as it is in a container which stores the ink for a long period of time, a pigment which is one of the components of the ink precipitates. When the ink is circulated by supplying the ink to a nozzle and collected while keeping the pigment precipitating, clogging occurs in the circulation path. Further, unevenness occurs in the color tone for printing on a recording medium, and therefore, a trouble that it is difficult to recognize the recorded letters as letters. An inkjet recording apparatus using such a pigment-based ink needs a mechanism for stirring the ink in a container for preventing the trouble.

As a background art of this technical field, an inkjet recording apparatus including "an ink container and a stirring device" and an inkjet recording apparatus wherein "a stirring bar of a magnetic body is disposed in an ink container and a stirrer and a motor are disposed in a lower part of the ink container, and the rotation speed of the stirring bar is controlled". In this literature, the outline of a structure such that the stirring bar in the ink container and the motor in the lower part of the ink container rotate at the same speed is illustrated in FIG. 5, but a specific structure of the stirrer is not disclosed.

In an inkjet recording apparatus for a pigment ink, a stirrer is used for stirring an ink in a container, and a method in which the ink is stirred while whirling up the ink by rotating a stirring bar in the container is adopted. In such an inkjet recording apparatus for a pigment ink, when the ink is left as it is without stirring for a certain period of time, a pigment component in the ink in the ink container precipitates in a container bottom part and prevents the normal operation of the stirring bar in some cases. Therefore, a stirrer mechanism capable of rotating a stirring bar by a larger rotary torque is desired.

The inventive inkjet recording apparatus provides an inkjet recording apparatus having a stirrer mechanism which rotates a stirring bar in an ink container by a larger rotary torque.

In order to solve the above-mentioned problems, for example, configurations described in the claims are adopted.

The present application includes a plurality of means to solve the above-mentioned problems. One example of the means is an inkjet recording apparatus including an ink container which stores an ink for printing on a printing object, a nozzle which is connected to the ink container and ejects the ink, a charging electrode which charges the ink to be ejected from the nozzle and used for printing, a deflection electrode which deflects the ink charged by the charging electrode, a gutter which collects the ink that is not used for printing, and a stirring mechanism which stirs the ink stored in the ink container, wherein the stirring mechanism includes a stationary shaft and a rotating body which rotates around the stationary shaft, and is placed in a lower part of the ink container.

According to the inventive inkjet recording apparatus, an inkjet recording apparatus having a stirrer function to rotate a stirring bar in an ink container by a larger rotary torque can be provided.

DETAILED DESCRIPTION OF EMBODIMENTS

Hereinafter, the inventive inkjet recording apparatus will be described with reference to the drawings. Incidentally, the inventive inkjet recording apparatus is not limited to the following embodiments.

Figure 1:
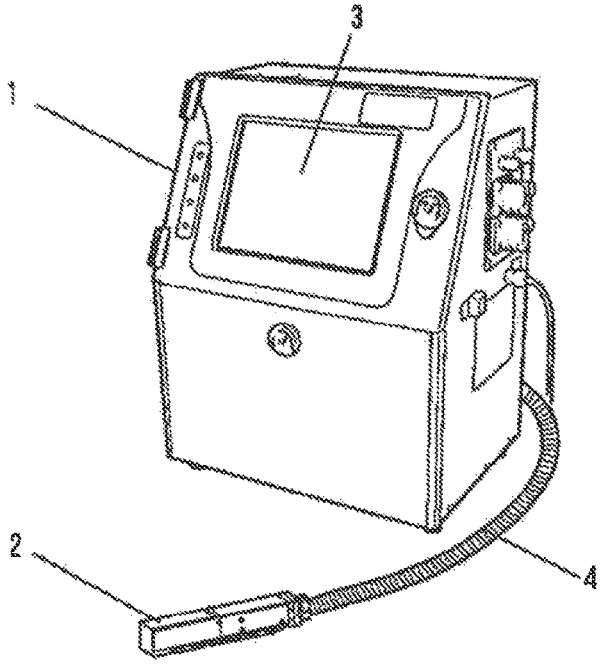
FIG. 1 shows a perspective view of an external appearance of an inkjet recording apparatus of inventive inkjet recording apparatus.

FIG. 1 shows a perspective view of an external appearance of an inkjet recording apparatus of the inventive inkjet recording apparatus.

In FIG. 1, the reference numeral 1 denotes an inkjet recording apparatus main body, 2 denotes a printing head, 3 denotes an operation display unit, and 4 denotes a conduit. In the inkjet recording apparatus, the operation display unit 3 is provided in the inkjet recording apparatus main body 1, the printing head 2 is provided externally, and the inkjet recording apparatus main body 1 and the printing head 2 are connected through the conduit 4.

Figure 2:
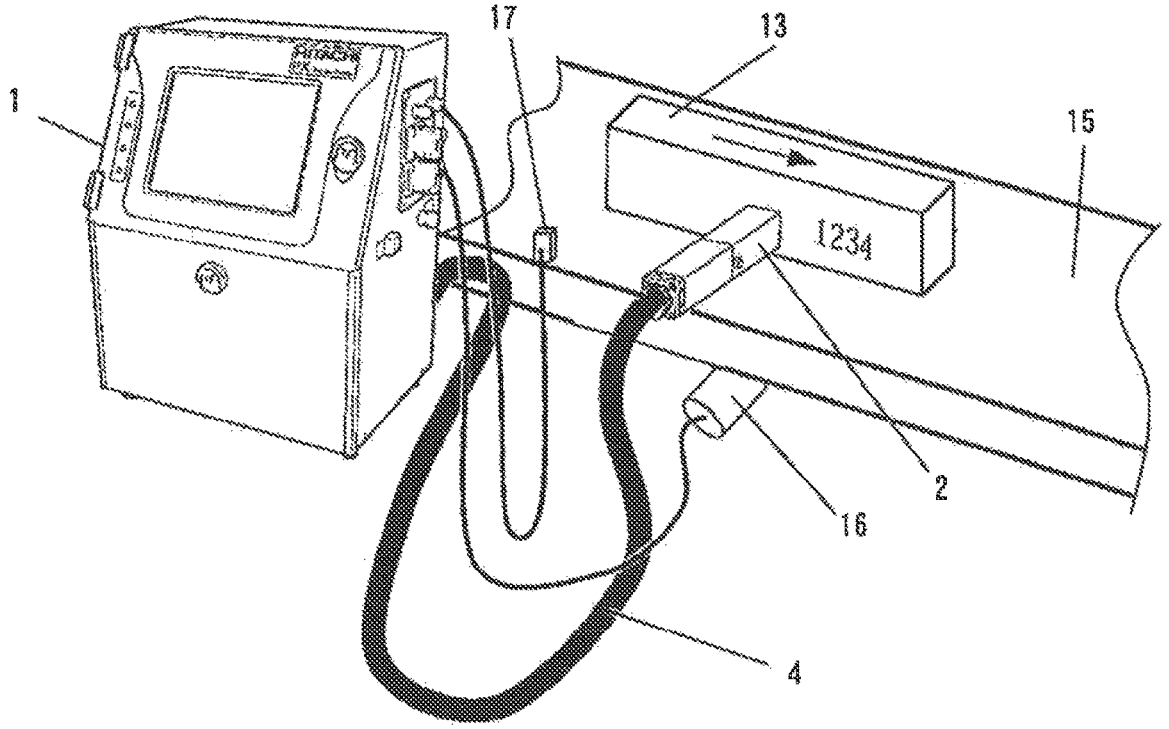
FIG. 2 is a perspective view showing a usage state of the inkjet recording apparatus.

Next, a usage state of this inkjet recording apparatus will be described with reference to FIG. 2. In FIG. 2, the reference numeral 1 denotes the inkjet recording apparatus main body, 2 denotes the printing head, 4 denotes the conduit, 13 denotes a printing object on which numbers or letters are printed, 15 denotes a belt conveyor which conveys the material to be printed, 16 denotes a rotary encoder which measures a conveying distance of the belt conveyor 15, and 17 denotes a printing sensor.

The inkjet recording apparatus is, for example, installed in a production line in a factory which produces foods, beverages, etc. and the main body 1 is placed at a position where a user can operate it. The printing head 2 is placed at a position where the printing head 2 can be brought close to a printing object 13 to be fed on a production line such as the belt conveyor 15. On the production line such as the belt conveyor 15, the encoder 16 which outputs a signal in accordance with a feeding speed to the inkjet recording apparatus, and the printing sensor 17 which detects the printing object 13 and outputs a signal that instructs printing to the inkjet recording apparatus are placed for achieving printing with the same width regardless of the feeding speed. These members are connected to a control unit (not shown) in the main body 1. The control unit controls a charge amount or a charge timing for an ink particle 7C to be ejected from a nozzle 8 in accordance with the signal from the encoder 16 or the printing sensor 17 so that the ink particle 7C charged and deflected is adhered to the printing object 13 while the printing object 13 is passing over an area near the printing head 2 to effect printing.

Next, an operating principle of the inkjet recording apparatus will be described with reference to FIG. 3.

Figure 3:
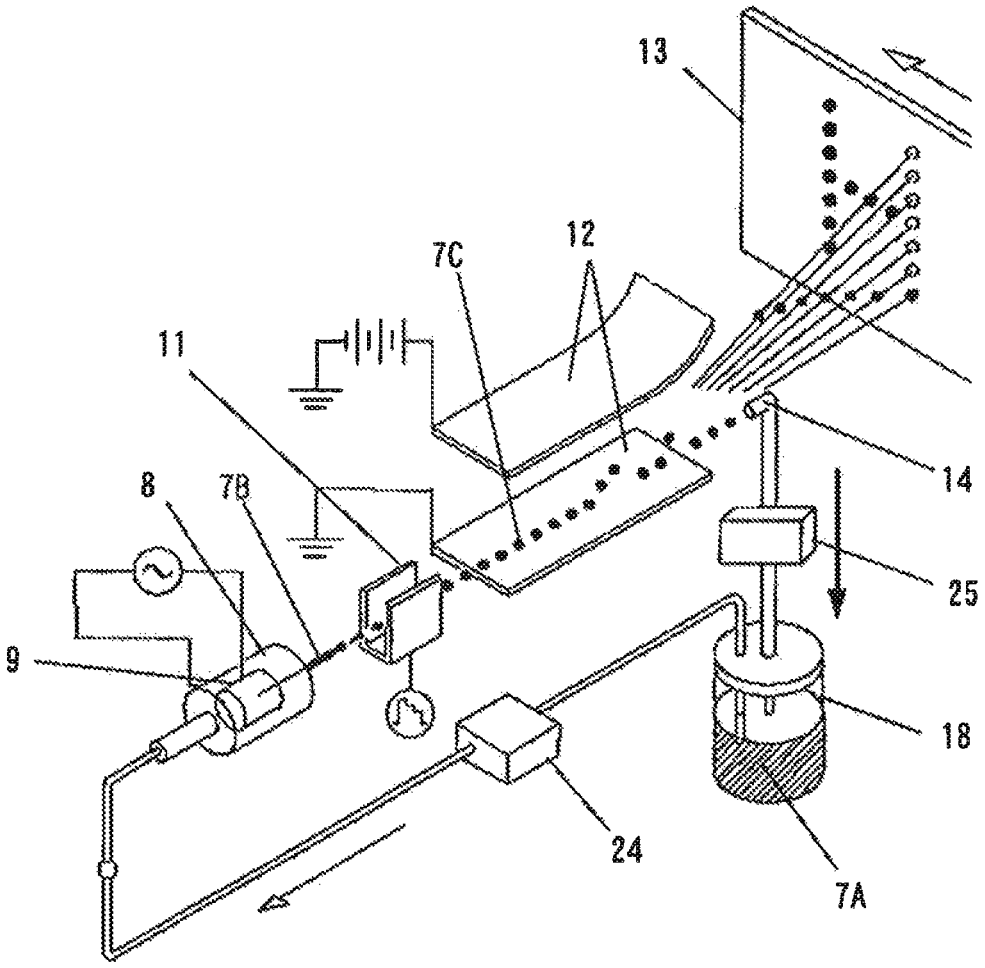
FIG. 3 is a schematic view showing an operating principle of the inkjet recording apparatus.

In FIG. 3, the reference numeral 18 denotes an ink container, 7A denotes an ink, 24 denotes a pump which pressurizes and sends out the ink, 9 denotes an electrostrictive element which oscillates at a predetermined frequency when a voltage is applied thereto, 8 denotes a nozzle which ejects the ink, and 7B denotes an ink column. The reference numeral 11 denotes a charging electrode which charges an ink particle, 7C denotes the ink particle, 12 denotes a deflection electrode, 13 denotes printing, and 14 denotes a gutter which collects the ink particle that is not used for printing.

The ink 7A in the ink container 18 is sucked and pressurized by the pump 24 so as to be formed into the ink column 7B and ejected from the nozzle 8. The nozzle 8 is provided with the electrostrictive element 9 and is configured to atomize the ink column 7B ejected from the nozzle 8 by applying oscillation at a predetermined frequency to the ink. The number of ink particles 7C formed in this manner is determined by the number of frequency of the excitation voltage applied to the electrostrictive element 9 and becomes the same as the number of frequency. The ink particles 7C may be charged by applying a voltage with a magnitude corresponding to the printing information using the charging electrode 11.

The ink particles 7C charged by the charging electrode 11 fly in the electric field between the deflection electrodes 12. A deflecting electric field is formed between a high-voltage electrode to which a high voltage of 5 to 6 kV is applied and a ground electrode placed, and the charged ink particles 7C are deflected by receiving a force in proportion to the charge amount and fly toward and land on the printing object 13. At this time, the landing position in the deflection direction of the ink particles 7C changes in accordance with the charge amount. Further, by moving the printing object 13 by the production line in a direction orthogonal to the deflection direction, the particles can be allowed to land also in the direction orthogonal to the deflection direction, and as a result, a letter is formed by a plurality of landing particles, and thus, printing is performed. The ink particle 7C which is not used for printing linearly flies between the deflection electrodes 12 and is captured by the gutter 14, and thereafter is collected in a main ink container 18 through the path.

Next, the configuration of the inkjet recording apparatus main body 1 will be described with reference to FIG. 4.

Figure 4:
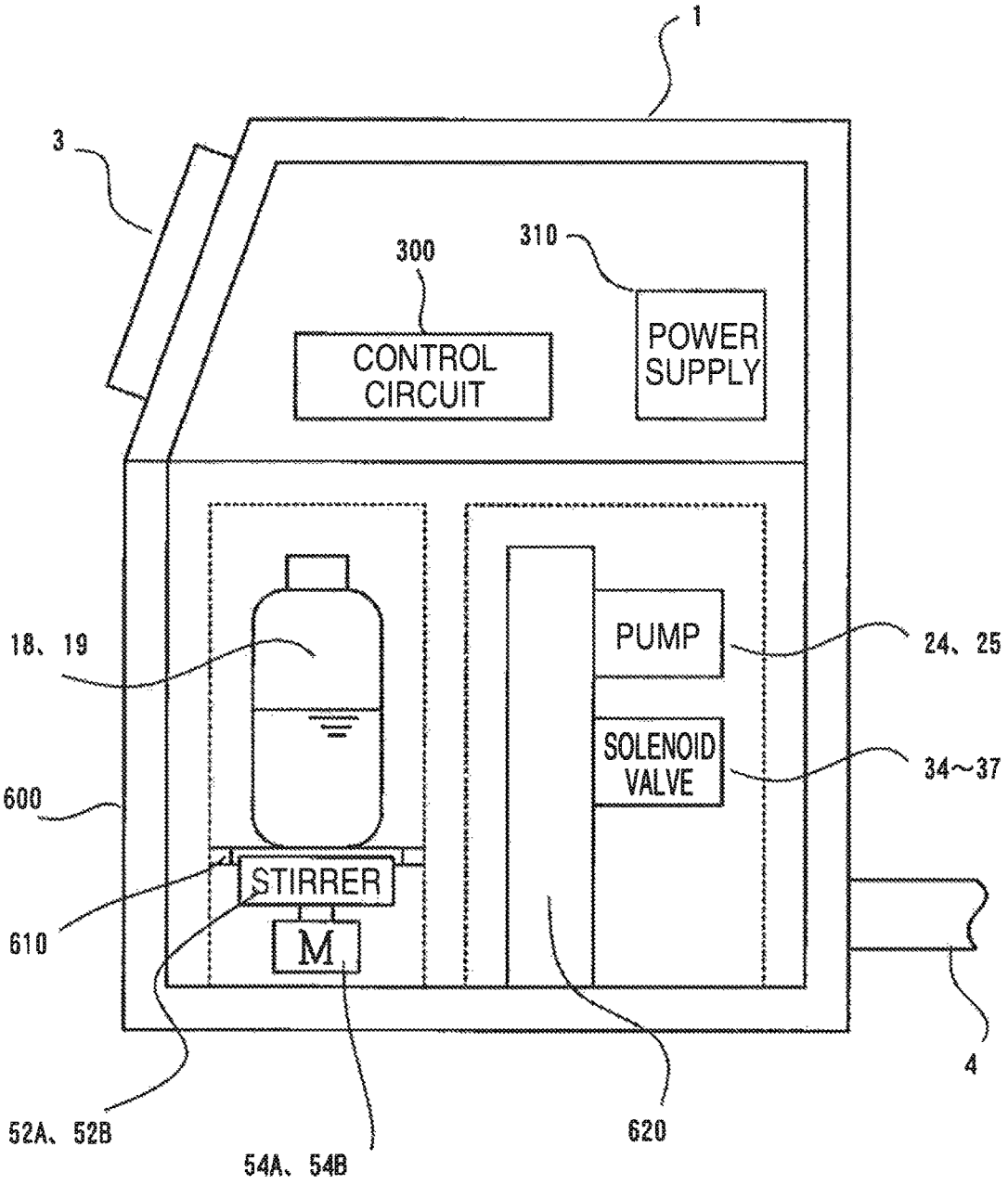
FIG. 4 is a cross-sectional view of an internal structure of a main body of the inkjet recording apparatus.

FIG. 4 shows a vertical cross-sectional view of the inkjet recording apparatus main body, and in an upper part of the inkjet recording apparatus main body 1, a control circuit 300 and an electrical component such as a power supply 310 which supplies an electrical current to the control circuit are placed, and on the front surface of the upper part, a display panel 3 capable of inputting data is placed. Further, on the front side of a lower part of the main body 1, the main ink container 18 which stores the ink to be supplied to the nozzle and an auxiliary ink container 19 (not shown) are stationary on a container base 610. Here, the auxiliary ink container has the same configuration as the main ink container and stirring of the ink is performed, and therefore, the explanation thereof is omitted. Then, under the container base 610, a stirrer 52A for stirring the ink and a motor 54A for operating the stirrer 52A are placed.

In addition, on the rear side of the lower part of the main body 1, components for controlling a circulation system such as a flow path board 620, solenoid valves 34 to 37, and pumps 24 and 25 are housed, and to the back surface of the main body 1, the printing head 2 is connected through the conduit 4. The length of the conduit 4 is generally 4 to 6 m. In the conduit 4, a tube through which the ink flows in and out, a high-voltage power supply line for applying power to the respective electrodes, and a control line are placed.

Further, the inkjet recording apparatus main body 1 is configured such that by opening a door 600 on the front surface of the lower part of the inkjet recording apparatus main body 1, the main ink container 18 and the auxiliary ink container 19 can be taken out from the main body 1, and thus, maintenance such as replenishment and discharge of the ink or a solvent can be easily performed.

Next, the configuration of the ink container according to a first inventive inkjet recording apparatus will be described with reference to FIG. 5.

Figure 5A:
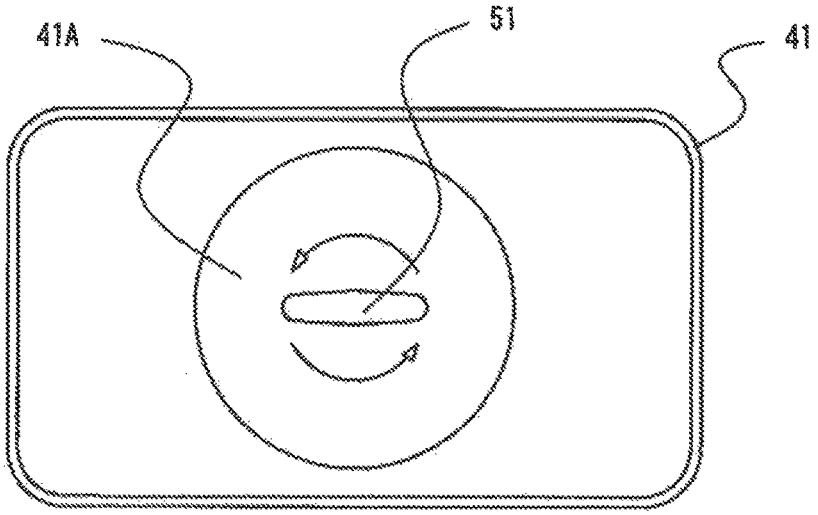
FIGS. 5A and 5B show a vertical cross-sectional view of an ink container of the inkjet recording apparatus.
Figure 5B:
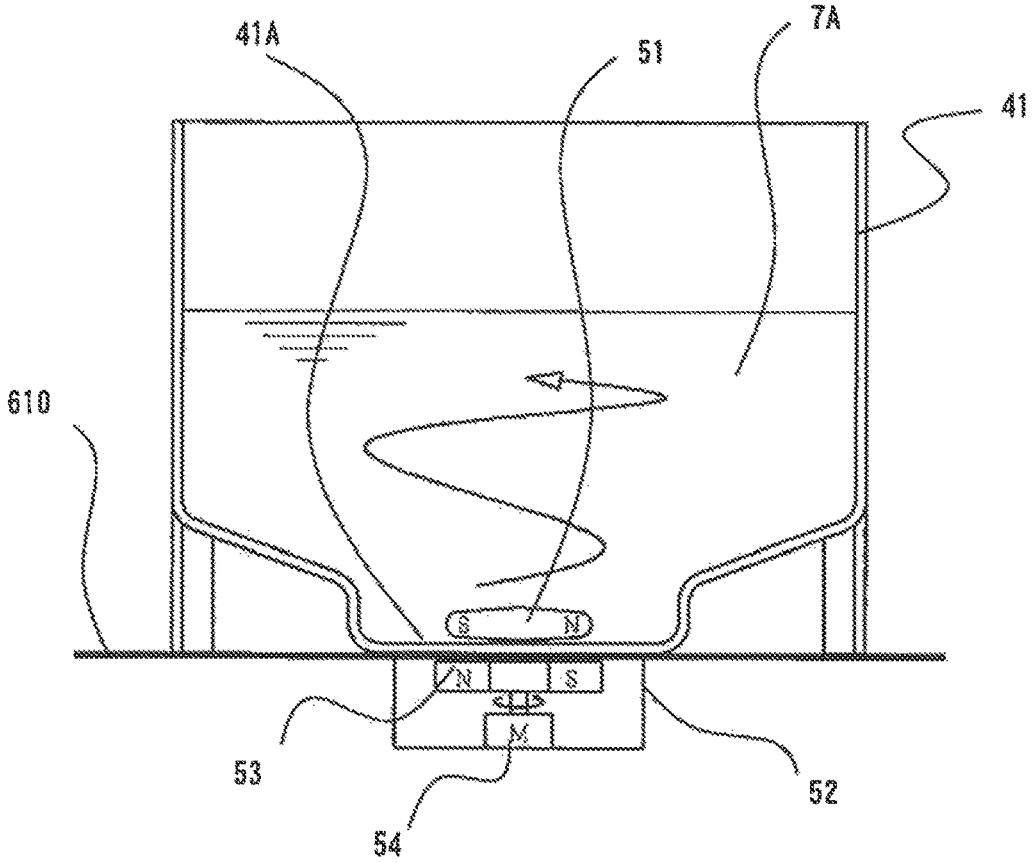

With respect to the ink container to be used for the main ink container 18, FIG. 5 is an explanatory view of the ink container in the first inventive inkjet recording apparatus, and FIG. 5(*a*) shows a plan view of the ink container, and FIG. 5(*b*) shows a vertical cross-sectional view thereof.

In FIG. 5, the reference numeral 41 denotes the ink container, 7A denotes a pigment-based ink, 41A denotes an ink container bottom part, 51 denotes a stirring bar, 52 denotes a stirrer, 53 denotes a rotating body, 54 denotes a motor, and 610 denotes a container base.

The ink container 41 has a ink container bottom part 41A, and is provided with the stirring bar 51 in an upper part of the bottom surface 41A, and the pigment-based ink 7A is stored inside the ink container 41. Further, the ink container 41 is placed in an upper part of the container base 610, and in a lower part of the container base 610, the stirrer 52 is placed. In addition, the pigment ink 7A in the ink container 41 is configured to be stirred by the stirrer 52. The stirrer 52 has the rotating body 53 made of a magnetic body and a motor 54 which rotates the rotating body 53, and the motor 54 and the rotating body 53 connected to the motor 54 are disposed inside the main body of the apparatus. Then, the ink container 41 is installed on the container base 610 so that the stirring bar 51 is placed on the rotating body 53. In the ink container 41, when the pigment-based ink 7A is left to stand while being kept stored in the container, a pigment component of the pigment-based ink 7A precipitates and deposits on the bottom surface 41A near the center of the container.

Next, a stirring operation in the ink container 41 will be described. The rotating body 53 composed of a magnetic body is provided in the stirrer 52 in the first inventive inkjet recording apparatus, and the rotating body 53 rotates by operating the motor 54. As the magnetic body, a permanent magnet or the like is used. By receiving the magnetic field of this magnet, the stirring bar 51 formed from a magnet also rotates in conjunction with the rotating body. Therefore, a convective flow is generated in the ink, so that the pigment-based ink 7A in the ink container is stirred.

Figure 6:
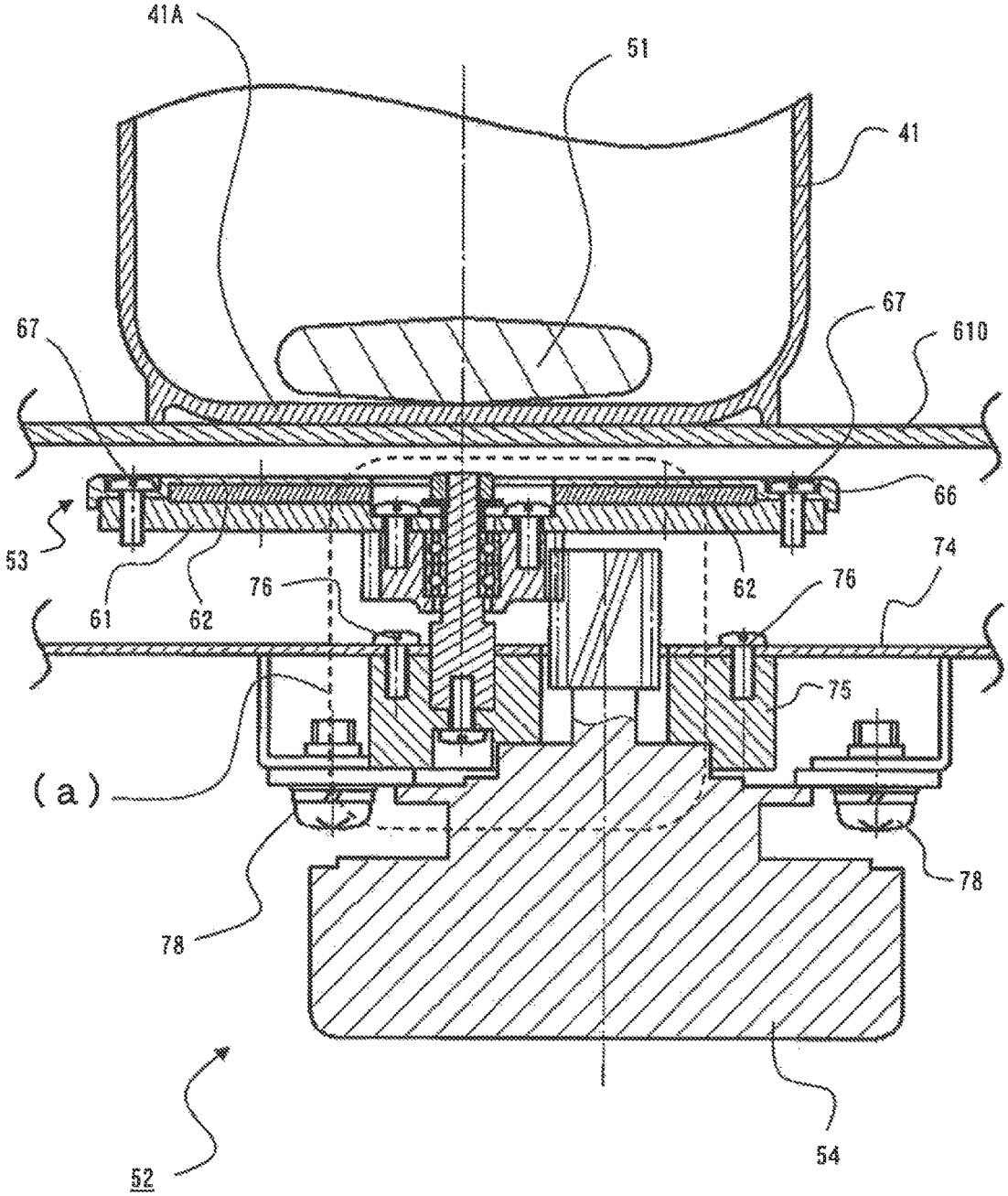
FIG. 6 shows a vertical cross-sectional view showing an overall configuration of a stirrer of the inventive inkjet recording apparatus.
Figure 7:
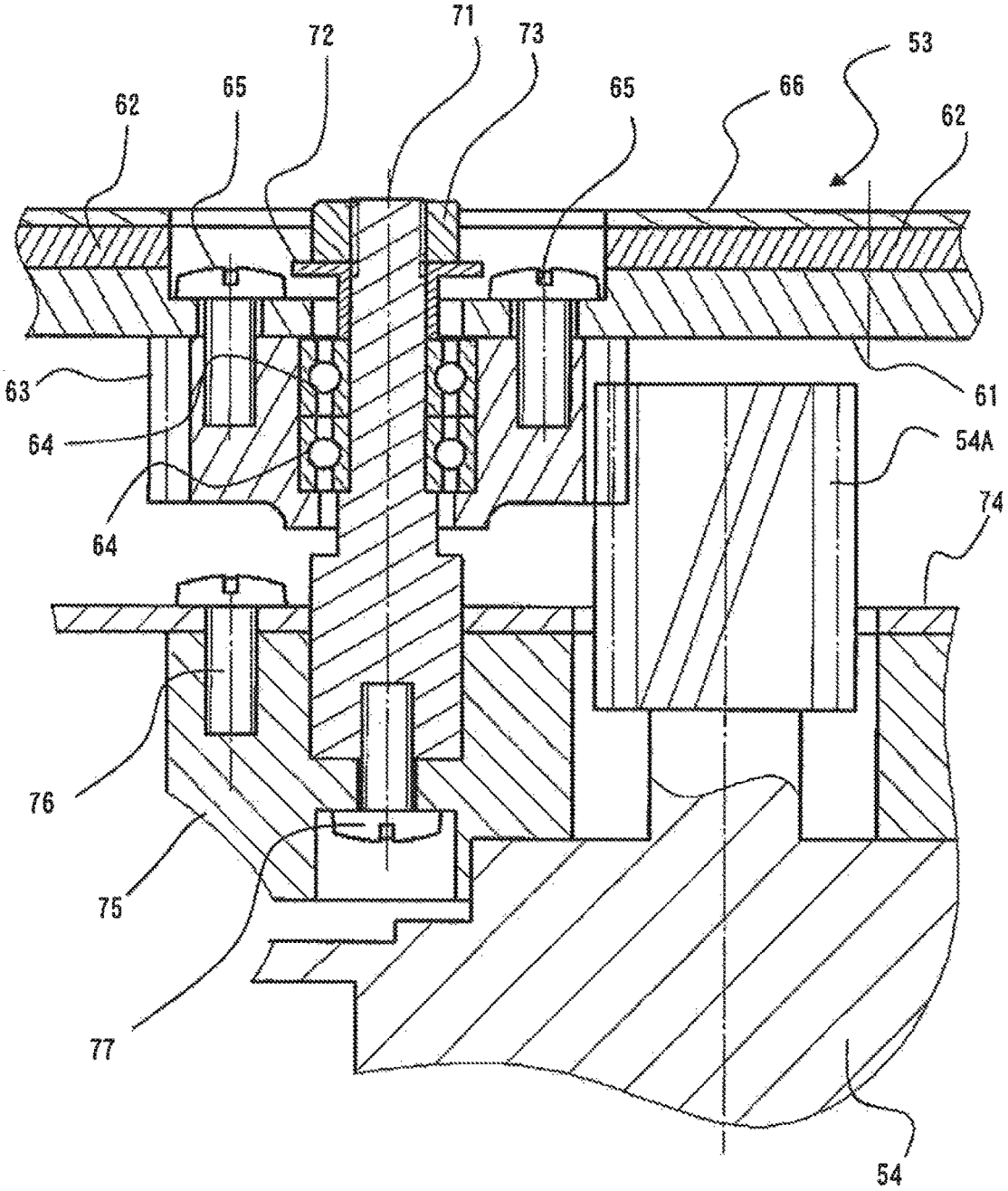
FIG. 7 shows a partially enlarged view of a portion (a) in FIG. 6.
Figure 8:
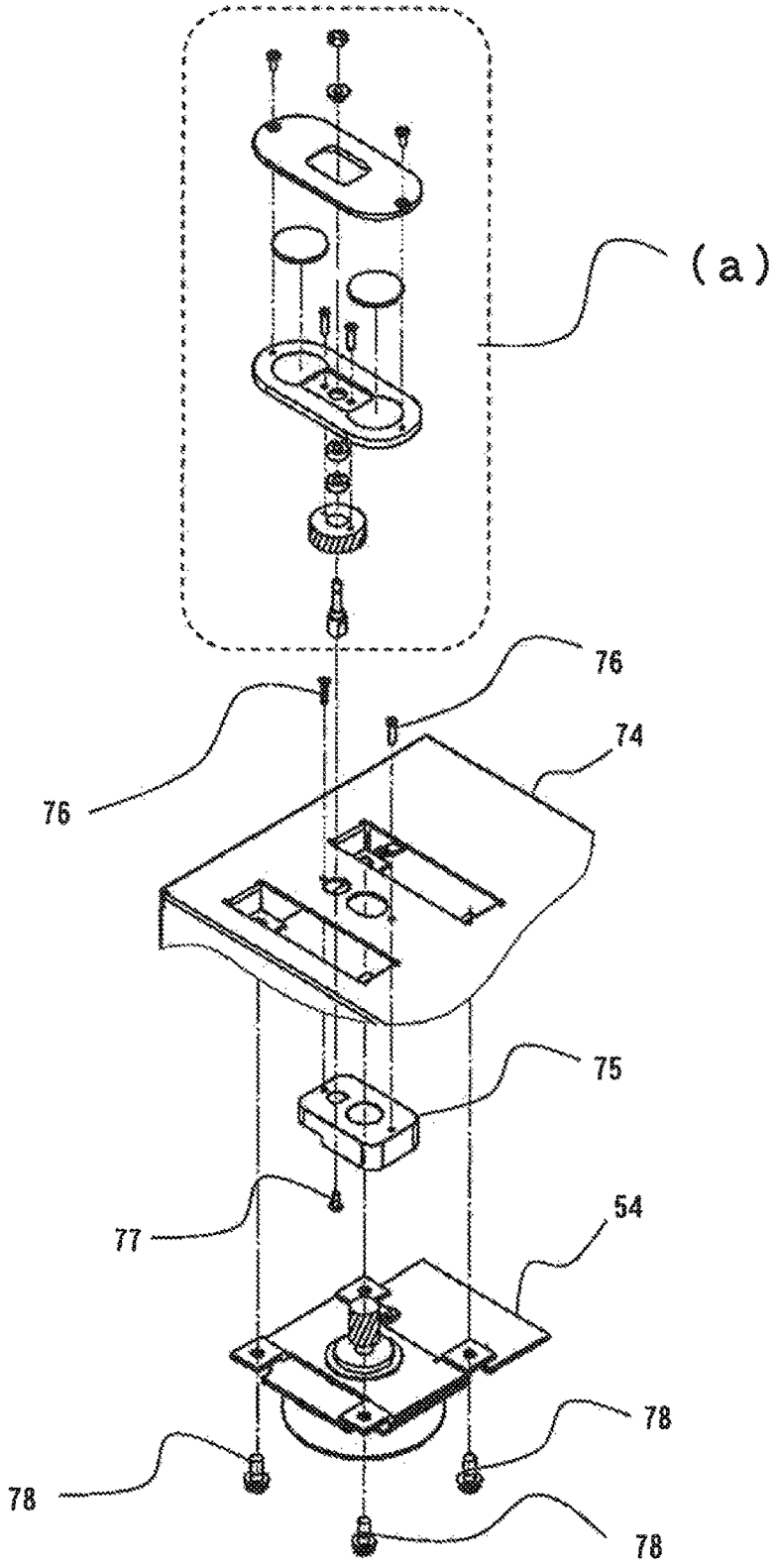
FIG. 8 shows an exploded perspective view of a stirrer unit of the inventive inkjet recording apparatus.
Figure 9:
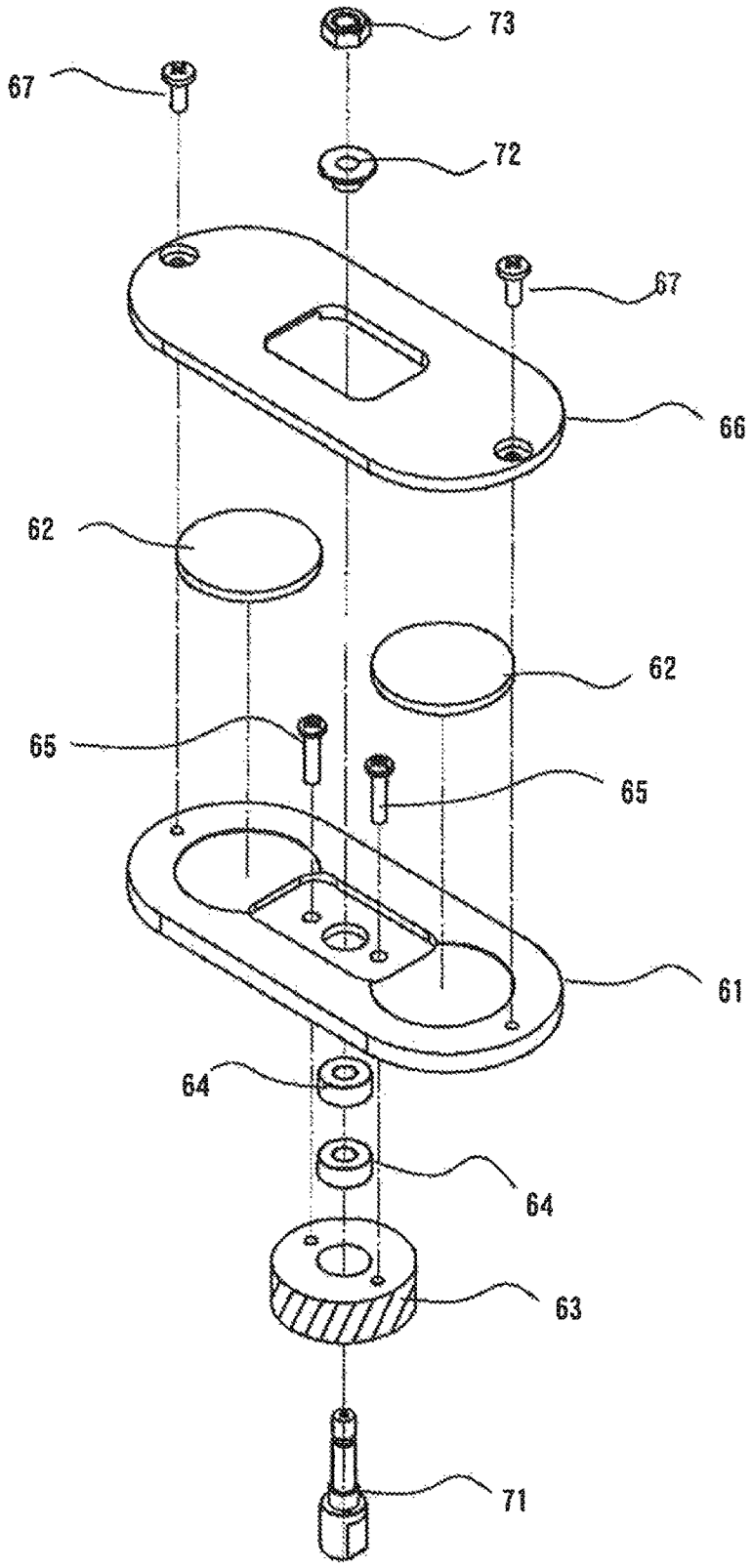
FIG. 9 shows a partially enlarged view of a portion (a) in FIG. 8.
Figure 10:
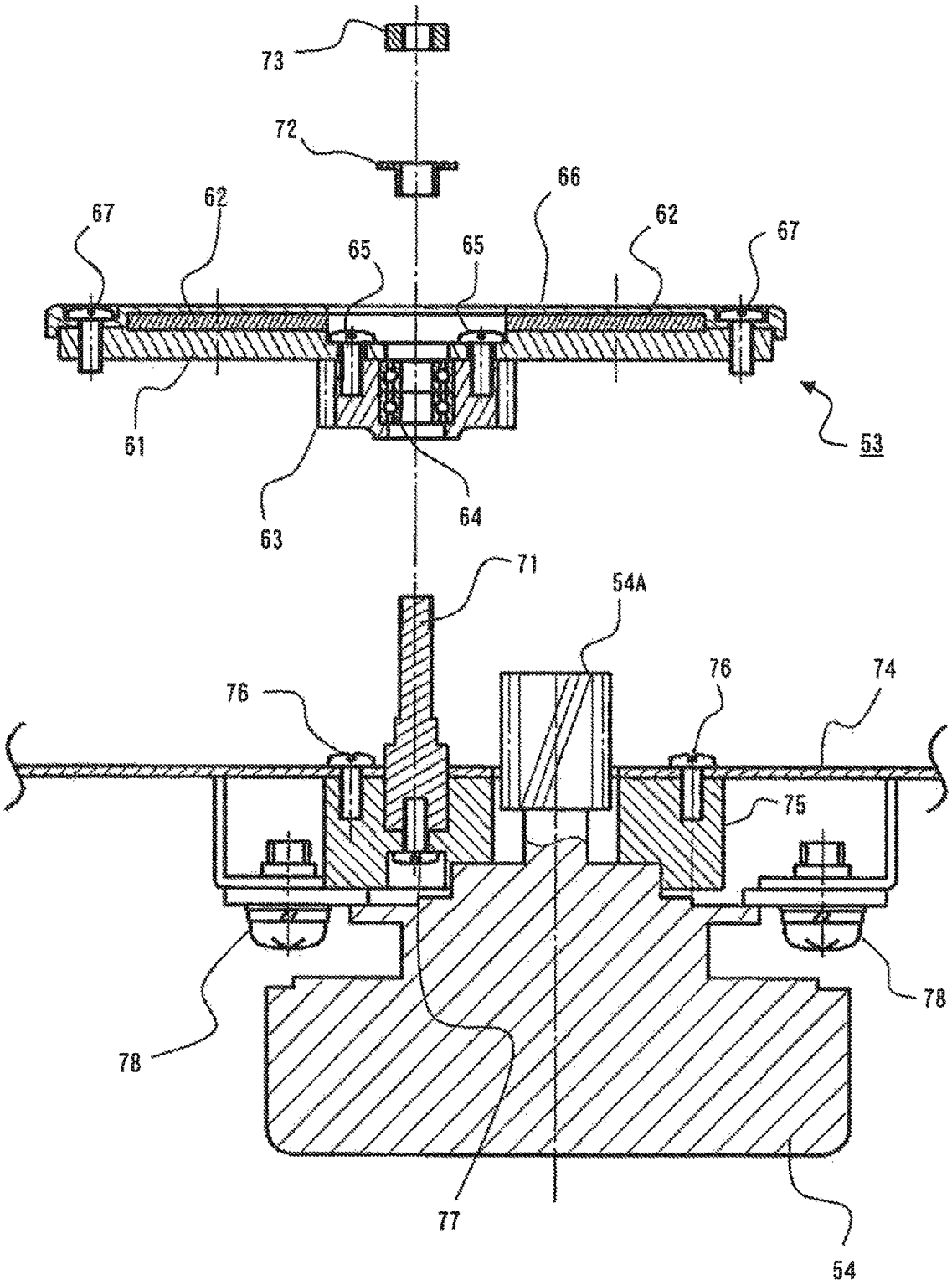
FIG. 10 shows an exploded detached vertical cross-sectional view of a rotating body of the inventive inkjet recording apparatus.

Next, the configuration of the stirrer 52 according to the inventive inkjet recording apparatus will be described with reference to FIGS. 6 to 10. In the drawings, FIG. 6 shows a vertical cross-sectional view of an overall configuration of the stirrer 52 of the inventive inkjet recording apparatus, and FIG. 7 shows a partially enlarged view of a portion (a) in FIG. 6. Further, FIG. 8 shows an exploded perspective view of the stirrer 52 of the inventive inkjet recording apparatus, and FIG. 9 shows a partially enlarged view of a portion (a) in FIG. 8. Then, FIG. 10 shows a state where the rotating body of the inventive inkjet recording apparatus is detached.

In FIGS. 6 and 8, as previously described with reference to FIG. 5, the ink container 41 is placed in the upper part of the container base 610, and the ink container 41 holds the stirring bar 51 on the ink container bottom part 41A. Further, in the lower part of the container base 610, the stirrer 52 for rotating the stirring bar 51 is installed.

The stirrer 52 includes a stirrer base 74 stationary to a lower part of the container base 610, an S-stationary table 75 attached to the stirrer base 74 with a screw C 76, a stationary shaft 71 attached to the S-stationary table 75 with a screw D 77 and extended in a rod shape in an upper part of the stirrer base 74, and the rotating body 53 installed so as to rotate around a stationary shaft 71 at the same speed as the stirring bar 51.

The rotating body 53 is configured such that a bearing 64 is pressed in a hole at the center, and an S-gear 63 having teeth formed on an outer periphery, a yoke 61 attached to the S-gear 63 with a screw A 65 and formed from a magnetic material, and two magnets 62 placed diagonally in an upper part of the yoke 61 are included. In the yoke 61, a hole 61A for passing the rotation shaft 71 therethrough is formed at the center and a shallow counterbore 61B is formed diagonally to the hole 61A at the center so as to facilitate the attachment of the magnet 62. The magnet 62 is curved convexly toward the ink container 41 in the upper part from the shallow counterbore 61B, and by combining the yoke 61 and the magnet 62, it becomes possible to form a most suitable magnetic field between the same and the stirring bar 51 disposed on the container bottom part 41A.

Further, a screw is formed in an upper end portion of the rotation shaft 71, and an S-collar 72 for fixing an inner ring of the bearing 71, and a nut 73 for fixing the S-collar 72 are attached thereto. According to this, the S-gear 63 is attached to the stationary shaft 71 through the bearing 64, and therefore can smoothly rotate around the stationary shaft 71.

Further, in the rotating body 53, in order to prevent the magnet 62 from falling, an S-cover 66 is attached to the yoke 61 with a screw B 67.

Next, a driving mechanism for the S-gear 63 according to this inventive inkjet recording apparatus will be described. To the stirrer base 74, an S-motor 54 is attached using a screw E 78. In the S-motor 54, an S-motor gear 54A is formed on a central axis. The S-motor gear 54A is placed so as to engage with the S-gear 63, and the axial accuracy of the central axes of the S-motor gear 54A and the S-gear 63 is enhanced by the positioning shape of the S-stationary table 75 so that abrasion or noise of the gear due to the engagement of the gears is prevented. Further, with respect to a load applied to the S-gear 63 by the rotation of the S-motor gear 54A, the members are arranged so that the load can be received and borne by the bearing 64 as much as possible by placing the bearing 64 attached to the center of the S-gear 63 near the center on an extension of a line of the engagement. According to this, it becomes possible to increase the service life of the components of the S-gear 63 and the bearing 64.

Further, the motor 54 used in this inventive inkjet recording apparatus can change and control the rotation speed or rotation direction. In the case where a period of being left as it is without stirring becomes longer and the pigment component has deposited on the ink container bottom part 41A, the pigment component has also deposited on the stirring bar 51, and therefore, even if the rotating body 53 of the stirrer 52 rotates, it sometimes becomes difficult for the stirring bar 51 to follow by the magnetic force. In such a case, by decreasing the rotation speed of the rotating body 53 or periodically changing the rotation direction thereof, an impact is given to the pigment component depositing around the stirring bar 51 so as to move the pigment component, and thus, the ink container bottom part 41A can be brought to a state where the stirring bar 51 is easy to rotate. By doing this, the stirring bar 51 follows the rotating body 53 and comes to operate, and therefore, the ink in the ink container 41 can be smoothly stirred.

Further, by detaching the S-nut 73 and the S-collar 72 from the stationary shaft 71 as shown in FIG. 10, the rotating body 53 can be detached. According to this, if the S-gear 63 or the like breaks down, the rotating body 53 can be easily exchanged.

Further, in order to prevent the magnet 62 from being moved out of position or being detached by a centrifugal force due to the rotary motion of the rotating body 53, a configuration in which the S-cover 66 is attached to an upper part of the yoke 61 using the screw B 67 so as to cover at least a portion of the magnet 62 may be adopted.

In this inventive inkjet recording apparatus r, it is described that the second gear 54A to be engaged with the gear 63 is driven by the motor 54, however, a configuration in which the second gear 54A is rotated using another motive power (for example, wind power or the like) may be adapted.

According to such a configuration, since the magnet 62 and the stirring bar 51 can be brought closer to each other, a higher magnetic field can be formed, and therefore, an inkjet recording apparatus including a stirrer 52 capable of stirring more stably can be provided.

Further, by driving the gear 63 not directly, but through the second gear 54A, for example, it becomes possible to adjust the number of revolutions of the power or the rotary torque for driving the stirrer 52 within some range by changing the size of the gear 63, and therefore, it becomes easy to select components, and thus, an inkjet recording apparatus having improved productivity can be provided.

1: inkjet recording apparatus main body, 2: printing head, 3: operation display unit, 4: conduit, 7A: pigment-based ink, 7B: ink column, 7C: ink particle, 8: nozzle, 9: electrostrictive element, 11: charging electrode, 12: deflection electrode, 13: material to be printed, 14: gutter, 15: belt conveyor, 16: rotary encoder, 17: printing sensor, 18: main ink container, 19: auxiliary ink container, 24: pump (for supply), 25: pump (for collection), 34 to 37: solenoid valves, 41: ink container, 41A: ink container bottom part, 51: stirring bar, 52: stirrer, 53: rotating body, 54: S-motor, 54A: S-motor gear, 61: yoke, 62: magnet, 63: S-gear, 64: bearing, 65: screw A, 66: S-cover, 67: screw B, 71: stationary shaft, 72: S-collar, 73: S-nut, 74: stirrer base, 75: S-stationary table, 76: screw C, 77: screw D, 78: screw E, 300: control circuit, 310: power supply, 600: door, 610: container base, 620: flow path board

The invention claimed is:

1. An inkjet recording apparatus, comprising:

an ink container that stores an ink for printing on a printing object; and a stirring mechanism that stirs the ink stored in the ink container, wherein the stirring mechanism includes a stationary shaft fixedly attached to another stationary member of the inkjet recording apparatus and a rotating body that rotates around the stationary shaft, and the stationary shaft and the rotating body are disposed under the ink container.

2. The inkjet recording apparatus according to claim 1, wherein the rotating body is separable from the stationary shaft.

3. The inkjet recording apparatus according to claim 1, wherein the rotating body includes a bearing disposed on the stationary shaft.

4. The inkjet recording apparatus according to claim 1, wherein the rotating body has a magnet that rotates a stirring bar.

5. The inkjet recording apparatus according to claim 4, wherein the rotating body has a cover attached to an upper part thereof that covers at least a portion of the magnet.

6. The inkjet recording apparatus according to claim 1, further comprising:

a nozzle which is connected to the ink container and ejects the ink.

7. The inkjet recording apparatus according to claim 1, further comprising:

a charging electrode that charges the ink to be ejected from a nozzle and used for printing.

8. The inkjet recording apparatus according to claim 1, further comprising:

a deflection electrode which deflects the ink charged by a charging electrode.

9. The inkjet recording apparatus according to claim 1, further comprising:

a gutter that collects the ink that is not used for printing.

10. An inkjet recording apparatus, comprising:

an ink container that stores an ink for printing on a printing object; and a stirring mechanism that stirs the ink stored in the ink container, wherein the stirring mechanism includes a stationary shaft and a rotating body that rotates around the stationary shaft, the stationary shaft and the rotating body are disposed under the ink container, and a first gear is formed on an outer periphery of the rotating body.

11. The inkjet recording apparatus according to claim 10, wherein the stirring mechanism further comprises a second gear that engages with the first gear.

12. The inkjet recording apparatus according to claim 11, wherein the second gear rotates in conjunction with a motor.

13. The inkjet recording apparatus according to claim 11, wherein the second gear rotates integrally with a motor.

14. The inkjet recording apparatus according to claim 11, wherein the rotating body includes a bearing disposed radially inward from a line of engagement between the first gear and the second gear.

15. The inkjet recording apparatus according to claim 14, further comprising:

a magnetic stirring bar wherein the magnetic stirring bar is disposed in the ink container and the rotating body spins in tandem with the magnetic stirring bar.

16. An inkjet recording apparatus, comprising:

an ink container that stores an ink for printing on a printing object; and a stirring mechanism that stirs the ink stored in the ink container, wherein the stirring mechanism includes a stationary shaft and a rotating body that rotates around the stationary shaft, the stationary shaft and the rotating body are disposed under the ink container, and the rotating body is rotatable in different directions.

17. The inkjet recording apparatus according to claim 16, wherein the rotation direction is changed by changing a rotation direction of a motor.

* * * * *